CANT FORMING MACHINE

This invention relates in general to new and useful lumber forming machines and more particularly to a machine for forming cants of predetermined lengths for further sawing into boards and pieces of the required dimension. The machine is particularly adapted for forming cants to be sliced into slats and frame pieces of pallets.

Heretofore complexed holding means have been required to first hold a log so that it may be generally squared after which the squared log is passed through the usual source for cutting the same into cants. The squaring of the log necessarily results in the waste of a considerable portion of the periphery of the log.

It is also known to cut grooves into logs and thereafter move the logs onto guides received in the grooves. However, in the past when grooves have been so formed, they have served solely the purpose of guiding the logs and in the further operations on the logs, the guide grooves have been removed before the logs are passed into the usual cant forming saws. This has also resulted in the waste of material.

In accordance with this invention, it is proposed to place a log in a trough, after which a pusher automatically picks up the log and while the log is still supported in the trough, a pair of saws engage the lower portion of the log on opposite sides thereof and cuts a pair of guide grooves therein. The leading portion of the log immediately engages guides which pass into the grooves cut by the saws so that control of the movement of the log at all times is maintained. The first cuts in the log are in fact cant defining cuts os that the cuts are in no way wasted.

After the log has passed onto the stationary guides, a molding head forms a flat on the bottom of the log, which flat is to be utilized later in the supporting of the log during the terminal portion of the cant forming operation. The flat formed on the bottom of the log is spaced below the first cuts and may, in certain instances, be utilized in defining pieces which may be utilized, for example, as grade stakes.

When the lower portion of the log is to be utilized as grade stakes, a pair of vertically disposed molding heads engage the log and form vertical finished surfaces on the log on opposite sides thereof and below the first saw cuts.

In the next operation, the log is passed through multiple horizontally disposed gang saws so as to define a plurality of vertically spaced cants all disposed on opposite sides of a central vertically disposed cant. Finally, a pair of vertical saws are engaged by the log at a time when the forward portion of the log is supported on a horizontal support bar and vertically cut the log on the opposite sides of the central cant, automatically dividing from the log the plurality of horizontally disposed cants and the lower pieces. The resultant cants now may be placed in a conventional gang saw slicing apparatus for forming the desired width slats and other pieces.

The log is pushed through the entire machine by a reciprocating pusher which is carried by an endless chain. The endless chain is connected to the pusher by means of a slip connection wherein when jams, occur, the pusher may remain stationary even though the chain is being driven. Further, the pusher is pivotally mounted so that is may reciprocate back over a log already positioned for movement through the machine with the pusher hinging upwardly to ride over the log.

With the above and other objects in view that will hereinafter appear, the nature of the invention will be more clearly understood by reference to the following detailed description, the appended claimed subject matter, and the several views illustrated in the accompanying drawings.

IN THE DRAWINGS:

FIG. 1 is a schematic top plan view of the cant forming machine an shows generally the arrangement of components thereof.

FIG. 2 is a schematic vertically sectional view taken generally along the line 2—2 of FIG. 1 and shows the manner in which a log may be cut to length and then moved into a trough for engagement by the conveyor means for movement through the remainder of the cant forming machine.

FIG. 3 is a schematic transverse vertical sectional view taken generally along the line 3—3 of FIG. 1 and shows the formation of initial guide cuts in the log.

FIG. 4 is an enlarged schematic sectional view taken along the line 4—4 of FIG. 1 and shows the log supported by guides received in the first saw cuts.

FIG. 5 is an enlarged schematic sectional view taken along the line 5—5 of FIG. 1 and shows a lower molding head forming a flat on the underside of the log.

FIG. 6 is an enlarged schematic sectional view taken along the line 6—6 of FIG. 1 and shows vertical molding heads facing the lower portion of the log below the initial saw cuts on opposite sides of the log.

FIG. 7 is an enlarged schematic vertical sectional view taken along the line 7—7 of FIG. 1 and shows the passage of the log through gang saws for the purpose of cutting the log into vertically spaced cants.

FIG. 8 is an enlarged schematic transverse vertical sectional view taken along the line 8—8 of FIG. 1 and shows the log being passed through a pair of vertical saws which cuts the log into a central vertical cant, cants disposed on opposite sides of the vertical cant, and into two smaller pieces.

FIG. 9 is an enlarged fragmentary transverse sectional view taken through an upper portion of the cant forming machine and shows the details of the conveyor for moving logs therethrough.

FIG. 10 is an enlarged fragmentary vertical sectional view showing specifically the connection between the pusher carriage and the chain.

FIG. 11 is an enlarged perspective view of the upper clamp plate for interlockingly engaging the conveyor chain.

Referring now to the drawings in detail, it will be seen that there is illustrated a cant forming machine formed generally in accordance with this invention, the machine being generally identified by the numeral 15. It is to be understood that the cant forming machine 15 is constructed to take logs of a predetermined length and to cut the logs into cants and pieces which may be further cut, as necessary into slats or boards and other pieces of predetermined cross-sections. The illustrated machine is particularly adapted for cutting pieces in the formation of pallets, which pieces have a nominal width or height on the order of four inches. Accordingly, the cants cut in accordance with this disclosure would have a width of four inches. However, this dimension is in no way limiting as far as the machine is concerned.

FIG. 1.
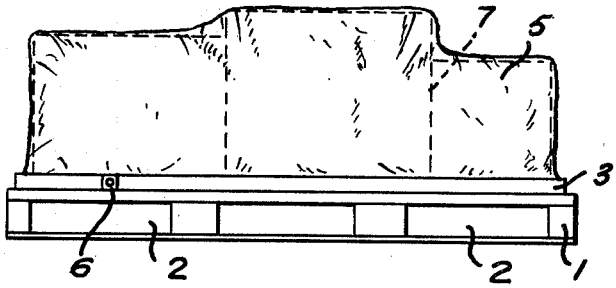
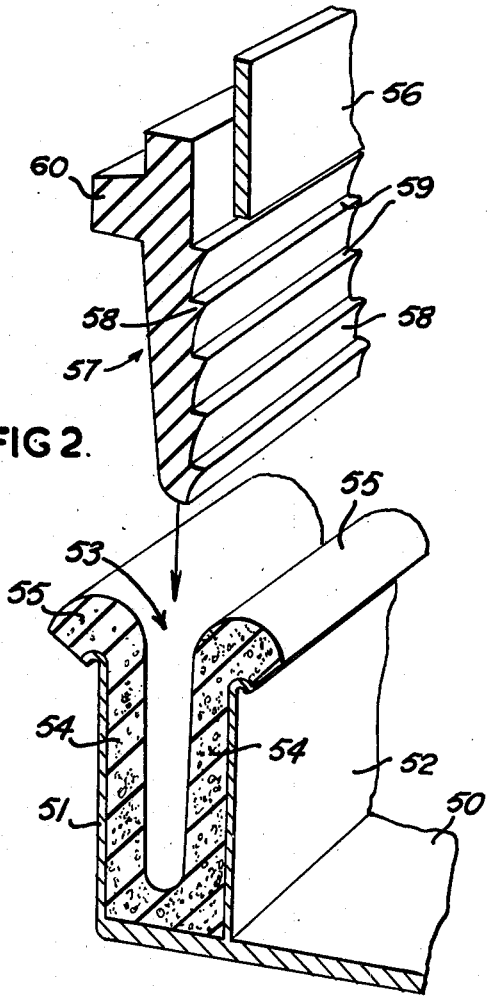
FIG 2.
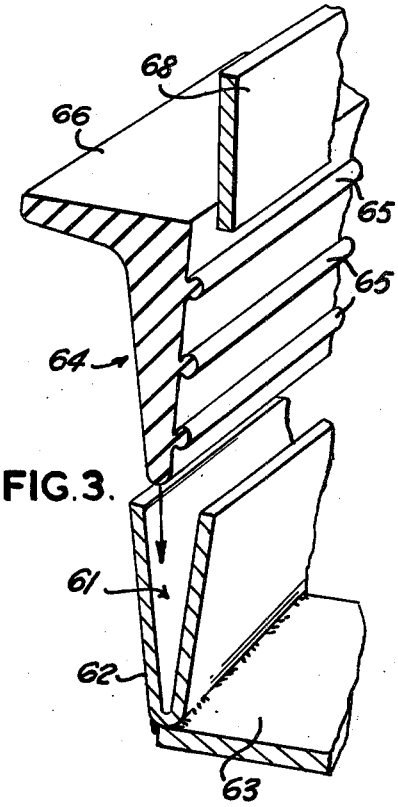
FIG. 3.
FIG. 6.
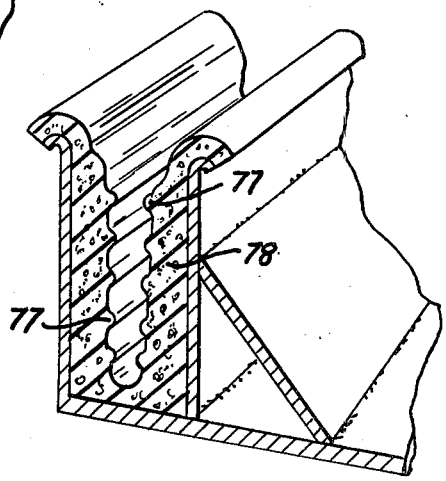
FIG. 4.
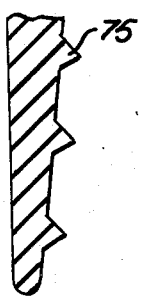
FIG. 5.
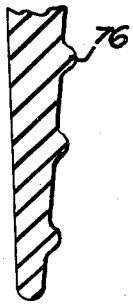

CONTAINERS HAVING FLUID-TIGHT SEALING MEANS

CROSS-REFERENCES TO RELATED APPLICATIONS

This application is divided out of Application Ser. No. 746,614 filed Dec. 1, 1976 and entitled "CONTAINERS HAVING FLUID-TIGHT SEALING MEANS", now U.S. Pat. No. 4,114,668.

BACKGROUND OF THE INVENTION

1. Field of the Invention

This invention relates to containers having a fluid-tight sealing means for sealing a flexible cover sheet of impermeable material to an impermeable base or other structure formed at least partly of rigid or semi-rigid material and which may be evacuated or pressurised to protect goods on said base.

2. Prior Art

Containers of this type are known, for example, from British Pat. No. 1,191,921 and U.S. Pat. Nos. 3,850,214; 3,815,650 and 3,929,178. It is known, see, for example, U.S. Pat. No.3,850,214 to effect a seal between a flexible envelope and a base of rigid or semi-rigid material by making use of a flexible inflatable tube along the periphery of the sheet material which tube is inserted into a slot or groove in the rigid or semi-rigid material and then inflated into pressure engagement with the walls of the slot or groove. Such a sealing means finds particular application for containers where the base is formed of impermeable material and either air is evacuated from the container so that the flexible sheet collapses downwardly onto goods to hold them firmly on the base or in which a gas, for example dry air, is put into the envelope. The inflatable tube along the periphery of the sheet can be inserted into a groove or slot extending continuously around the base to effect a fluid-tight seal between the flexible sheet material and the base.

When such a container is used for long term storage, it is possible that there may be loss of fluid pressure in the inflated tube so that the tube is pulled out or partly pulled out of the slot or groove. This problem can arise particularly if the container is transportable as stresses may be applied to the cover when the container is moved. For this reason, it has been proposed in the aforementioned U.S. Pat. No. 3,850,214 to provide auxiliary securing means comprising a flap on the cover sheet which is mechanically secured by eyelets engaging hooks on the base of the container. Such a construction prevents the tube being pulled out of the groove or slot but does not necessarily ensure that the seal between the cover sheet and the base remains airtight if pressure is lost in the inflated tube.

SUMMARY OF THE INVENTION

It is an object of the present invention to provide an improved means for sealing the cover of the container to the base in which the use of two separate securing means is obviated.

According to this invention, a container comprises a flexible cover sheet of impermeable material and an impermeable base, the base having a load-carrying surface with an endless groove extending around that surface or at least around a major part thereof, said groove comprising two spaced upright wall members sealed to or integral with the base, and the cover having, around its periphery or attached to its periphery, an endless male member for inserting into said groove, said male member being formed at least partly of elastomeric material and shaped to be a force fit into said groove between said upright walls or between linings on said walls so as to form an airtight seal between the cover and the base and wherein valve means are provided in the base or the cover to permit the interior of the container to be pressurised or evacuated of air.

With this construction, the male member is forced into the endless groove or slot and is resiliently retained therein by the resilience of the elastomeric material of that member and/or by the resilience of the lining if a lining is provided in the slot or groove.

The male member may be a solid member which is a force fit in the slot or groove. In this case, preferably said endless male member is formed of elastomeric material shaped with ridges or projections on at least one of the surfaces facing a wall of the slot or groove. Preferably also with such a construction, the walls of said slot or groove are lined with a resilient material which is softer than the material of the male member.

In one form of construction, the male member has ribs or projections extending longitudinally along one or both of its side faces. Such ribs or projections might be formed as rounded beads or pointed or cusp-shaped projections. In one convenient form of construction the projections are wedge-shaped projections, the wedge shapes being such as to facilitate entry of the male member into the groove but having shoulders which resist withdrawal of the male member from the groove engaging into the soft lining of the groove.

Preferably the male member is shaped to have a rib or ribs or other projection which extends outwardly from the outer wall of the envelope beyond the outer edge of the outer wall of the groove when the male member is inserted in the groove. Such a rib or other projection facilitates manual gripping of the male member to force it into the groove when sealing the container and to remove it therefrom when unsealing the container.

The male member conveniently is formed of a relatively hard plastics material. This member may be formed integrally with the cover or may be secured thereto, e.g. by welding or by an adhesive or it may be separate from the cover; in the last-mentioned case, the peripheral portion of the cover is put into the groove and the male member then forced into the groove to wedge the cover therein.

The aforementioned lining of the groove is preferably of a soft resilient material for example rubber, which is softer than the male member. This lining material may have outwardly-turned portions or enlarged ends extending over the tops of the side walls of the groove.

The invention further includes within its scope a container comprising an impermeable base and a flexible impermeable cover, the base having a load-carrying surface with a continuous groove extending around that surface or at least the major part thereof, said groove comprising two spaced upright wall members sealed to or integral with the base and the cover having around its periphery or attached to its periphery an endless male member for inserting into said groove, which male member is formed of elastomeric material and shaped to be a force fit into said groove between said upright walls or between linings on said walls, to seal the cover to the base, valve means being provided in the base or cover to permit the interior of the container to be pressurised or evacuated of air. Preferably the walls of the groove, on their inwardly-facing surfaces, are lined with a resilient material which is softer than the material of said male member.

The aforementioned base is conveniently formed of metal but may be made of other materials. Preferably it is formed as a pallet. Such a pallet may be shaped in the known way for admission of the forks of a fork-lift truck underneath the impermeable base to enable the container to be lifted. The groove may be formed around the peripheral edge of the pallet or may be spaced, over the whole or part of its length, inwardly from the periphery of the base. This latter arrangement facilitates for example the fitting of posts on the base for the supporting of one pallet on top of another.

BRIEF DESCRIPTION OF THE DRAWINGS

FIG. 1 is a diagram showing, in elevation, a container of the type to which the present invention can be applied;

FIG. 2 is an exploded perspective view of part of a base and cover (in section) for forming one construction of container;

FIG. 3 is a view similar to FIG. 2 of another embodiment of the invention;

FIGS. 4 and 5 illustrate further forms of ribs on the male member; and

FIG. 6 illustrates the provision of ribs on a lining of a groove in another construction.

DESCRIPTION OF THE PREFERRED EMBODIMENTS

Referring to FIG. 1, there is shown diagrammatically a container for goods comprising a rigid impermeable base 1 constructed as a pallet with openings 2 for the forks of a fork-lift truck. Near the periphery of the base is an upstanding member 3 forming an endless groove (not shown) in which is secured the periphery of a flexible impermeable cover sheet 5, which is typically formed of butyl rubber. Valve means 6 are provided in the base 1, or alternatively in the cover 5 enabling air to be partially evacuated from within the container so that the cover sheet is drawn down onto goods 7 within the container. Only a small reduction in air pressure is necessary to ensure that the cover is pressed, by the outside atmospheric pressure, into tight engagement with goods on the base. The goods are thus firmly held on the base. The valve means may alternatively or additionally be arranged for pressurising the container, e.g. with dry air or with an inert gas as may be desired in some cases for storing goods.

The present invention is concerned more particularly with the manner of sealing the cover 5 to the base 1 and FIG. 2 illustrates one construction for this sealing means.

Referring to FIG. 2, there is shown part of a metal tray having an impermeable base 50 with two upright walls 51, 52 which define an endless groove 53 around the periphery of the base. The tray is conveniently constructed as a pallet, for example, with transverse members on its underside to enable the forks of a fork-lift truck to be inserted under the base 50 when the tray is resting on the ground. In the embodiment of FIG. 2, the groove is lined on both sides with soft rubber 54, this soft rubber extending over the top edges of the walls 51, 52 as shown at 55.

For storing goods on the tray, a flexible cover, part of which is shown at 56, which is formed of impermeable material is put over the goods and an endless male member 57, secured on the periphery of the cover and extending around the periphery thereof is forced into the groove 53 between the linings 54. The male member 57, in cross-section is tapered so that the thickness decreases towards its lower edge. In the embodiment illustrated, one face is formed with a series of wedge-shaped ribs 58 extending along the length of the male member, each rib having an upper shoulder 59 which engages in the soft rubber lining 54 to ensure that the male member 57 is held firmly in the groove. This male member 57 is formed of a resilient plastics material, preferably a harder material than the lining 54 and has an integral outwardly directed flange 60 which, when the member 57 is forced into the groove 53, extends outwardly over the top of the lining material 55 above the top of the outer wall 51. The flange 60 facilitates manual forcing of the male member into the groove when the container is to be sealed and withdrawal therefrom when the container is to be unsealed. The lower end of the male member engages the soft lining material at the bottom of the groove 53, the flange 60 engages the top of the lining and the side faces of the male member engage the inwardly-facing surfaces of the lining to give an airtight seal.

When the male member 57 has been inserted into the groove 53, air is partially evacuated from the region within the cover 55 through a valve (not shown) in the cover or, preferably, in the base. The vacuum holds the cover down onto any goods on the base so securing such goods firmly, as may be necessary for transport purposes.

FIG. 3 shows another construction in which the endless groove, shown at 61, is formed of a metal or ceramic member 62 with a smooth finish and secured around the periphery of a pallet 63. The male member, shown at 64 with longitudinally-extending ribs 65 and an outwardly-directed flange 66, is forced into the groove 60 to be gripped by compression of the resilient material. A cover of flexible impermeable material 68 is welded or otherwise secured to the male member 64 to form, with the pallet 63, a container which can be partially evacuated as described above.

FIGS. 4 and 5 illustrate at 75 and 76 respectively, alternative rib shapes for use on the male member. As shown at 77 in FIG. 6, the lining 78 of a groove may also be provided with longitudinally-extending ribs. Other rib shapes may be used on the lining, for example ribs of the shape shown in FIGS. 4 and 5.

I claim:

1. A container comprising a flexible cover sheet of impermeable material and an impermeable base, the base having a load-carrying surface with an endless channel extending around that surface or at least around a major part thereof, said channel comprising two spaced upright wall members on the base, and the cover having, around its periphery, an endless male member for inserting into said channel, said male member being formed at least partly of elastomeric material, said male member furthermore being wedge-shaped in section and dimensioned to be a force fit into said channel between said upright walls or between linings on said walls so as to form an airtight seal between the cover and the base, said male member furthermore having an integral flange extending outwardly over the top of the outer wall member of the channel when the male member is inserted in the channel, and wherein valve means are provided in the base or the cover to permit the interior of the container to be pressurized or evacuated of air.

2. A container as claimed in claim 1 wherein said endless male member is formed of elastomeric material shaped with ridges or projections on at least one of the surfaces facing a wall of the channel.

3. A container as claimed in claim 2 wherein the walls of said channel are lined with a resilient material which is softer than the material of the male member.

4. A container comprising an impermeable base and a flexible impermeable cover, the base having a load-carrying surface with a continuous groove extending around that surface or at least the major part thereof, said groove comprising two spaced upright wall members on the base and the cover having around its periphery an endless male member for inserting into said groove, which male member is formed of elastomeric material and is wedge-shaped in section to be a force fit into said groove to seal the cover to the base, said male member having an integral flange along its whole length, which flange extends outwardly over the top of the outer wall of the groove when the male member is inserted in the groove, and valve means being provided in the base or cover to permit the interior of the container to be pressurised or evacuated of air.

5. A container as claimed in claim 4 wherein the male member has ribs extending longitudinally along at least one of its side faces.

6. A container as claimed in claim 4 wherein said wall members form a V-section channel.

7. A container as claimed in claim 4, wherein the groove or slot is lined with an elastomer softer than the material of said male member and wherein the male member has longitudinally-extending wedge-shaped projections along at least one of its faces, the wedge shapes being such as to facilitate entry of the male member into the groove but having shoulders which resist withdrawal of the male member from the groove engaging into the soft lining of the groove.

8. A container as claimed in claim 1 wherein the male member is formed integrally with the cover.

9. A container as claimed in claim 1 wherein the male member is secured to the cover.

* * * * *